United States Patent [19]

Venot

[11] 4,301,358

[45] Nov. 17, 1981

[54] YARN HEATING DEVICE

[75] Inventor: Jean Venot, Roanne, France

[73] Assignee: ASA S.A., Roanne, France

[21] Appl. No.: 5,025

[22] Filed: Jan. 19, 1979

[30] Foreign Application Priority Data

Jan. 31, 1978 [FR] France ..... 78 02841

[51] Int. Cl.[3] ..... H05B 1/00

[52] U.S. Cl. ..... 219/388; 165/DIG. 24; 165/104.21

[58] Field of Search ..... 219/388 W, 341, 365; 165/105, 114, 107 D, DIG. 24; 122/488, 492

[56] References Cited

U.S. PATENT DOCUMENTS

| | | | |
|---|---|---|---|
| 2,761,272 | 9/1956 | Vawdamme et al. | 219/388 |
| 2,874,410 | 2/1959 | Kinney | 18/8 |
| 3,298,430 | 1/1967 | Kodaira | 219/388 |
| 3,395,433 | 8/1968 | Kodaira et al. | 219/388 |
| 3,638,411 | 2/1972 | Tsugawa et al. | 219/388 |
| 4,076,075 | 2/1978 | Venot | 219/388 |

FOREIGN PATENT DOCUMENTS

| | | | |
|---|---|---|---|
| 598044 | 5/1960 | Canada | 165/DIG. 24 |
| 1018922 | 1/1953 | France . | |
| 2153706 | 5/1973 | France . | |
| 2176283 | 10/1973 | France . | |
| 1141874 | 2/1969 | United Kingdom . | |

*Primary Examiner*—Arthur T. Grimley
*Assistant Examiner*—Bernard Roskoski
*Attorney, Agent, or Firm*—Arnold, White & Durkee

[57] ABSTRACT

A yarn heating device for closed or open oven use has a plurality of elongate chambers for heating fluid. These are connected at one end to a reservoir for heating fluid having a horizontal connecting pipeline and one or more vertical pipes below it, these pipes having heating means. The chambers are connected at their other ends to a common collector by respective vertical pipelines which have separators near the collector, the separators having small orifices.

9 Claims, 6 Drawing Figures

YARN HEATING DEVICE

Figure 1:
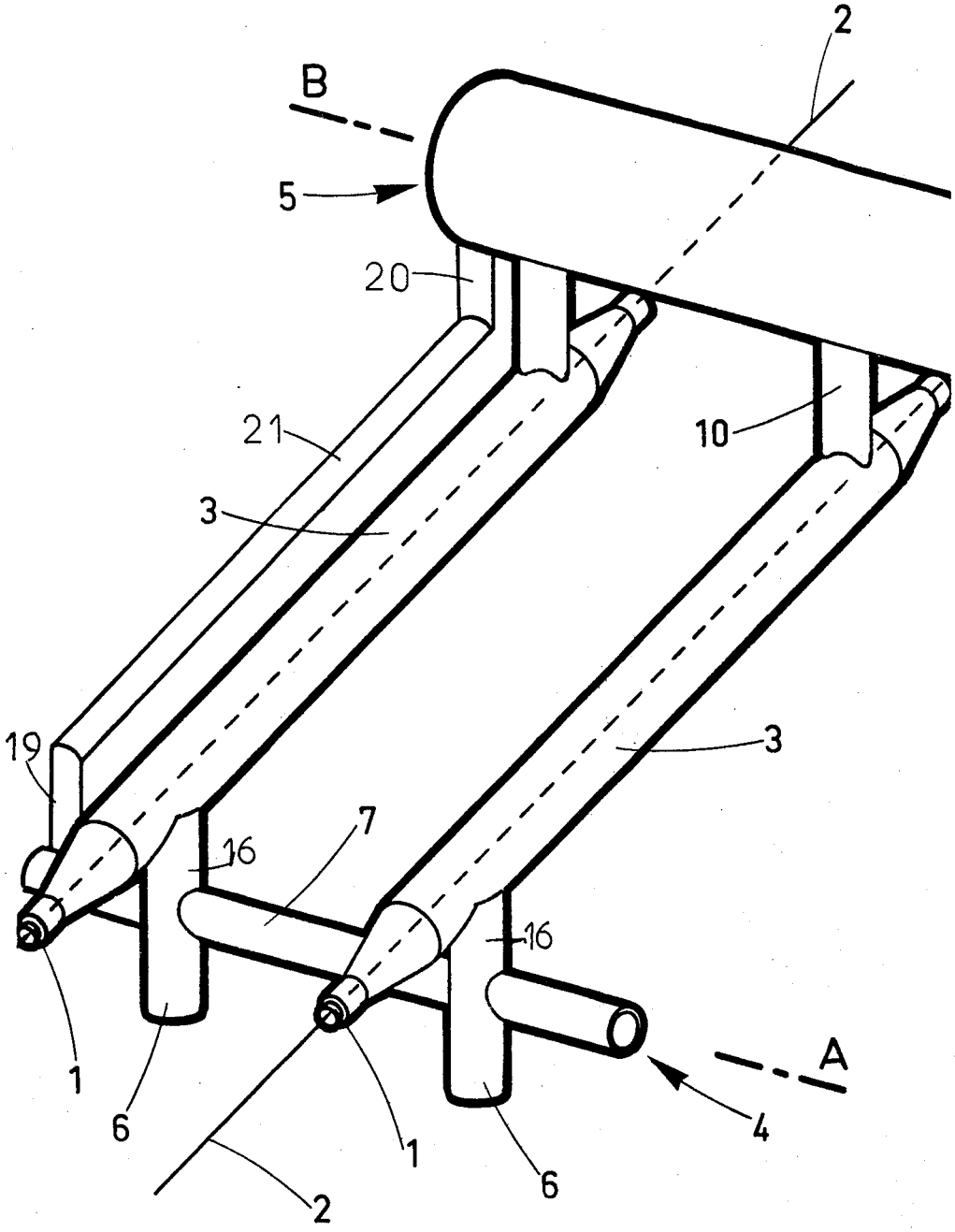

The present invention relates to a device for the heat treatment of yarns, especially of synthetic yarns.

In the description which follows, the invention will be particularly described in its application to false-twist texturising, but despite this the invention can find applications in other fields and, in general, in all cases where it is desired to heat-treat, with precision, yarns travelling at high speed.

In general terms, false-twist texturising consists of carrying out the following steps continuously: overtwisting a thermoplastic yarn, heating the yarn when in the twisted state, cooling it, untwisting it and, optionally, again heat-setting it in the partially relaxed state, before winding it up.

Various processes and devices have been proposed for carrying out the heat treatments of yarns in the course of such operations.

One such process, which is well known, consists of bringing the yarn into contact with a body which is heated by means of a heating fluid which can be treated to a high temperature and which transfers its heat to the body.

Advantageously, this fluid consists of a liquid comprising a mixture in suitable proportions of, for example, diphenyl and diphenyl ether. Such a composition, sometimes referred to in the literature by the name of "diphyl", is marketed under trademarks such as DOWTHERM or GILOTHERM. It is also possible to use, as the heating fluid, a mixture of benzyltoluene isomers, such as that marketed under the trademark MARLOTHERM L and in addition U.S. Pat. No. 2,761,262 has proposed heating the yarn to be texturised by passing it over a hollow curved metallic surface, inside which the hot heating fluid circulates.

French Pat. No. 1,018,922 describes a device for the heat treatment of a yarn, wherein heating is achieved by means of a fluid such as steam in direct contact with the yarn. Such a device is very complex, however, and is unsuitable for heating a yarn in a false-twist texturising operation.

U.S. Pat. No. 2,874,410 has proposed using, during the drawing-orientation operation, a yarn heating device which essentially consists of a hollow finger into which heating fluid in the form of vapour enters.

U.S. Pat. No. 3,298,430 and British Pat. No. 1,141,874 have proposed using the same means with heated metal tubes for setting the twist in the false-twist process. Such a device essentially comprises a closed receptacle containing a heating liquid, a heating element immersed in the said heating liquid, to vaporise it so that the said vapour fills the whole of the receptacle and thus keeps it at a uniform temperature, and, metal tubes immersed in the receptacle through which tubes the yarn to be treated passes.

In a practical embodiment, the device consists of two main horizontal receptacles, which are substantially parallel and are connected to one another by substantially vertical channels, the lower receptacle containing the heating liquid and the heating devices, and a metal tube intended for the passage of the yarn passing through the entire length of each vertical channel.

However, in the course of operation over a relatively long time, the vapours formed by trace liquids of low boiling point, such as water, and trace gases such as methane and ethane which cannot be condensed at the operating temperature, result in the rapid formation of blockages in the top part of the upper horizontal receptacle, thus preventing the vapour of the hot heating fluid from heating this part and from circulating freely. Hence, an abrupt drop in temperature tends to occur in the upper parts of the treatment tubes which should, of course be at the same temperature as other parts. This results in a downturn of the temperature curve along the tube, manifesting itself in practice, in the yarn thus treated, by a reduction in bulk, a deterioration of dyeing affinity, and the appearance of stripes after dyeing.

To overcome these disadvantages, U.S. Pat. No. 3,395,433, U.S. Pat. No. 3,638,411 and French Pat. No. 2,176,283 have proposed locating, between the horizontal receptacles, a separating chamber possessing a partition and a vapour return tube. This solution, which gives good results, nevertheless suffers from the disadvantages of being complex and expensive, of deteriorating in the long term, and, finally, of entailing a considerable additional consumption of power.

Furthermore, with such a device it is difficult to heat identically the various tubes through which the yarns pass, and differences in temperature from one tube to another are found.

To overcome these disadvantages, it has been further proposed, in French Pat. No. 2,153,706, to connect the channels enveloping each tube to the shared upper receptacle (usually referred to as the collector) by means of a pipeline which has a resistance to the passage of the fluid, and is intended to facilitate the circulation of vapour in the collector by increasing its speed of travel, the condensed liquid being returned to the heating chamber by means of a return tube which connects the collector to the said chamber, the return taking place under gravity.

Furthermore, in order to achieve an identical temperature from one tube to another, each channel is provided with a pressure-sensitive bellows to act as a means of regulating the temperature.

Such a device is complex because it necessarily requires an independent tube which ensures the return of the liquid, resulting from the condensation of the fluid, into the heating chamber, where it can be reheated.

It is increasingly the case, moreover, that on modern false-twist texturising frames, in order to reduce the height requirement of the equipment, particularly as increasing speeds of production which leads to greater lengths for the heating devices, the design engineers have proposed locating yarn heating devices not vertically but almost horizontally above the texturising frame.

According to the present invention there is provided a yarn heating device including a plurality of elongate chambers to be heated internally by a vapourised heating fluid, the chambers each being connected at one end to a reservoir for heating fluid, such reservoir including a horizontal pipeline which inerconnects the chambers and vertical pipes below and connected to the horizontal pipeline, the vertical pipes each having heating means, and the chambers being connected at their other ends, via respective vertical pipelines, to a cylindrical collector, for recovering vapours, which is above the chambers, each said vertical pipeline having at its upper end near the collector a separator element having at least one orifice of smaller diameter than the diameter of the pipeline.

The heating device of the invention is simple and efficient and can be used horizontally, or at any angle between the horizontal and the vertical. It provides a good uniformity of temperature over the entire heating distance, as well as good identity of temperatures from one position to another.

The device of the invention can be embodied to provide both so-called "closed ovens", that is to say ovens which possess a tube, passing through a heated enclosed chamber, for each yarn, and on so-called "open ovens" that is to say ovens in which the yarns is in contact with an external surface.

Advantageously, the ratio of the diameter of the orifices of the separator elements to the diameter of the pipeline in which they are located is selected so that when vapour is drawn off into any one of the chambers, this vapour preferably comes from the heating reservoir and not at the same time as a return stream from the shared collector.

In one embodiment, the device is provided with an amount of heating fluid such that both when hot and cold it only partially fills the horizontal pipeline.

Preferably the heating means are respective electrical resistances associated with the vertical pipelines. Advantageously, these resistances are connected to one another to form a single heating element.

The separator elements located inside the vertical pipelines which terminate at the collector advantageously each possess two orifices, the diameter of which is preferably between 1 millimeter and 5 millimeters, these orifices being extended by two channels, running in opposite directions, the end of one of these channels terminating inside the collector and the end of the other channel terminating substantially at the connection between the vertical pipeline and the collector.

Such an embodiment makes it possible to achieve very uniform operation from one position to another.

The connection of the various chambers to one another by the shared horizontal pipeline of the reservoir can be made either by causing the horizontal pipeline to terminate directly in each chambers or by using vertical connecting tubes associated with each chamber.

The first mentioned arrangement is particularly advantageous if it is desired to set up an open oven, whilst the second is particularly suitable for setting up a closed oven. In the second case, the vertical pipes possessing the heating elements can either be equal in number to or fewer than the chambers. They can be of the same diameter as the tubes.

If the device according to the invention is used for setting up a closed oven a tube, which is preferably made of stainless steel but could be of any other similar material, passes through each leak-proof chamber, each tube allowing the treatment of a moving yarn.

Such tubes can be covered with a highly heat-conducting material over part or all of their length, in accordance with the teachings of U.S. Pat. No. 4,076,075, and can be curved or straight depending on whether a first oven, located upstream of a false-twist spindle, or a second, resetting, oven located downstream of the spindle is involved.

In the case where the device is used for setting up an open oven, each chamber can have, at its periphery at least one guide channel in which the moving yarn can travel. Advantageously, each chamber possesses two parallel channels which allow two yarns to be treated simultaneously. These guide channels can either be rectilinear or curved.

A device or a group of devices according to the invention can if desired be surrounded by an insulating chamber and can also be combined with known means for recovery and disposal of the fumes produced during the treatment of the yarn.

Figure 2:
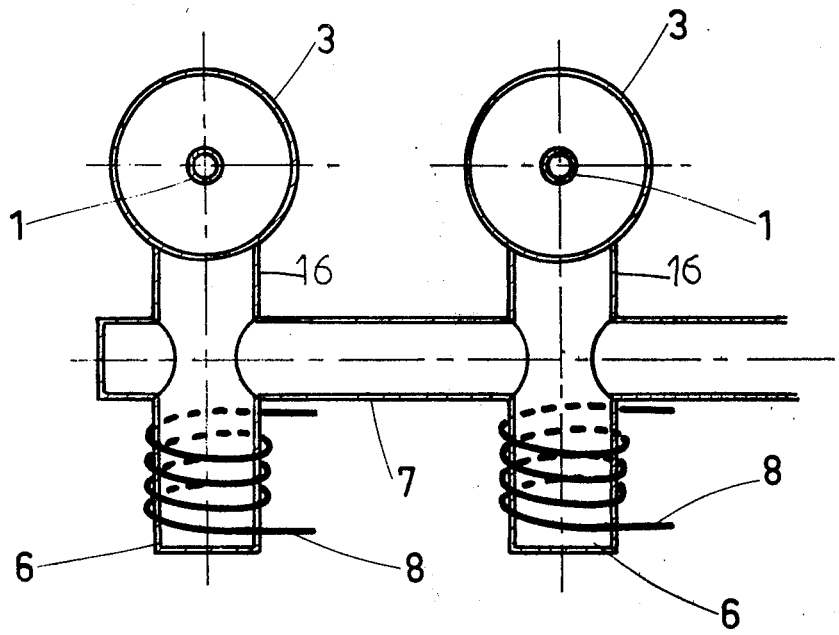
Figure 3:
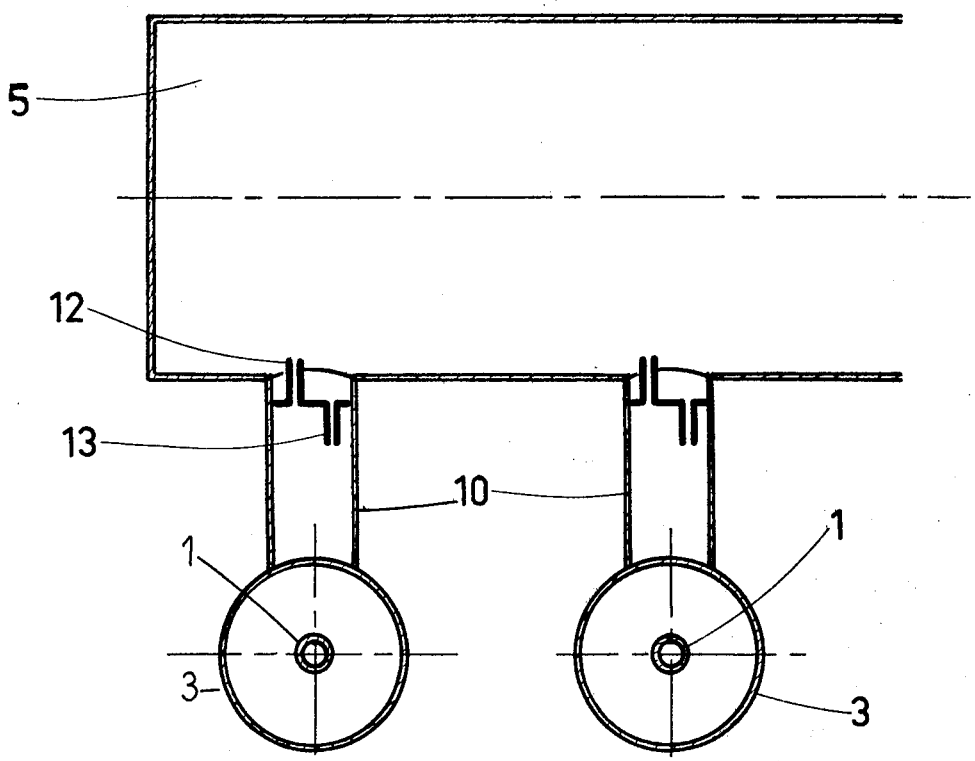
Figure 4:
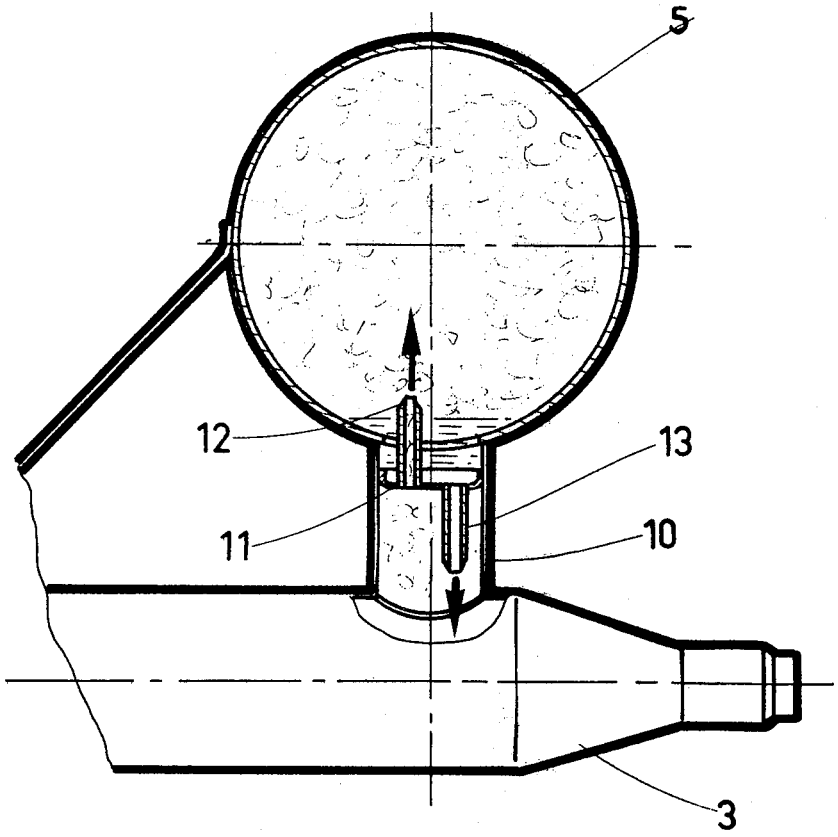
Figure 5:
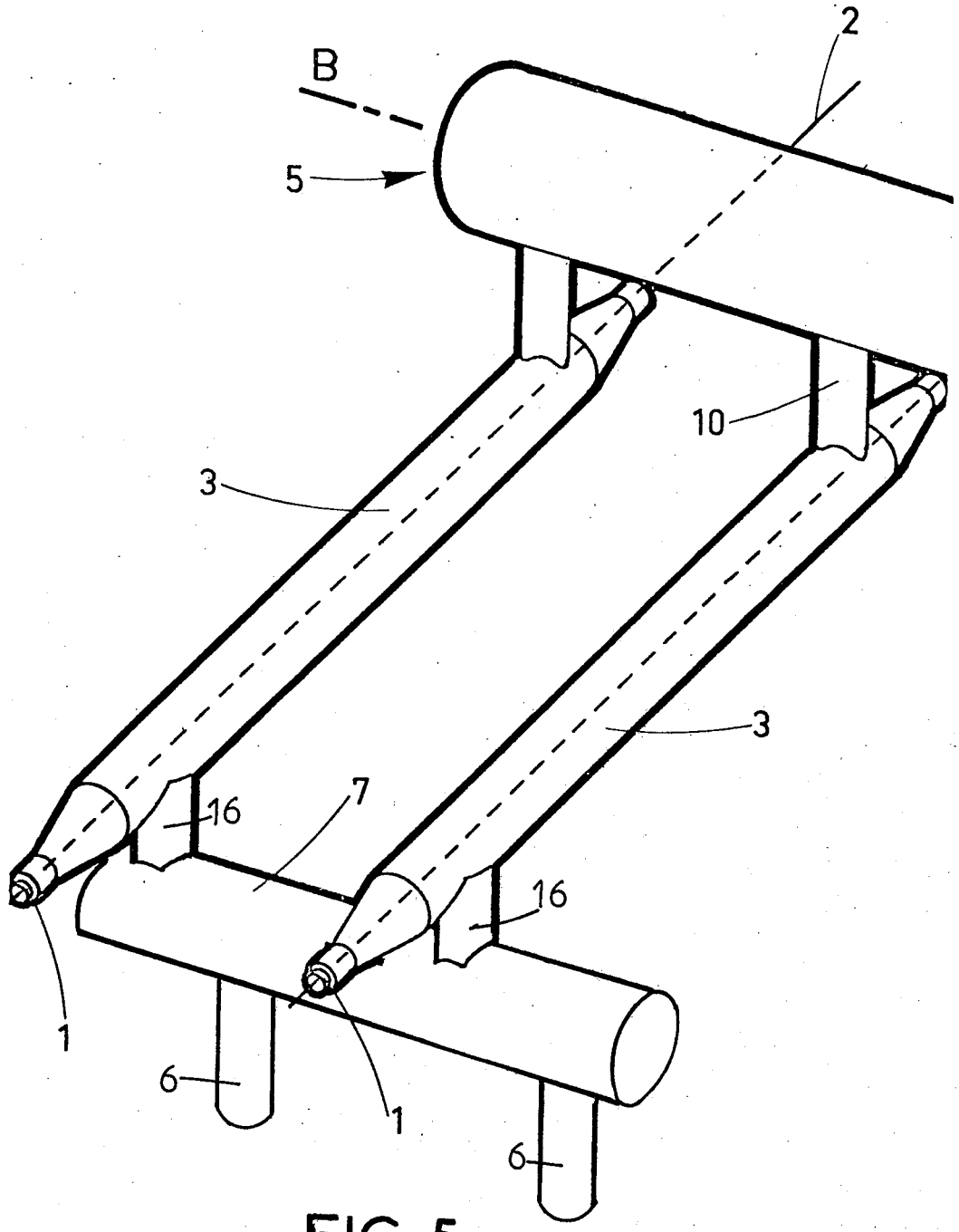
Figure 6:
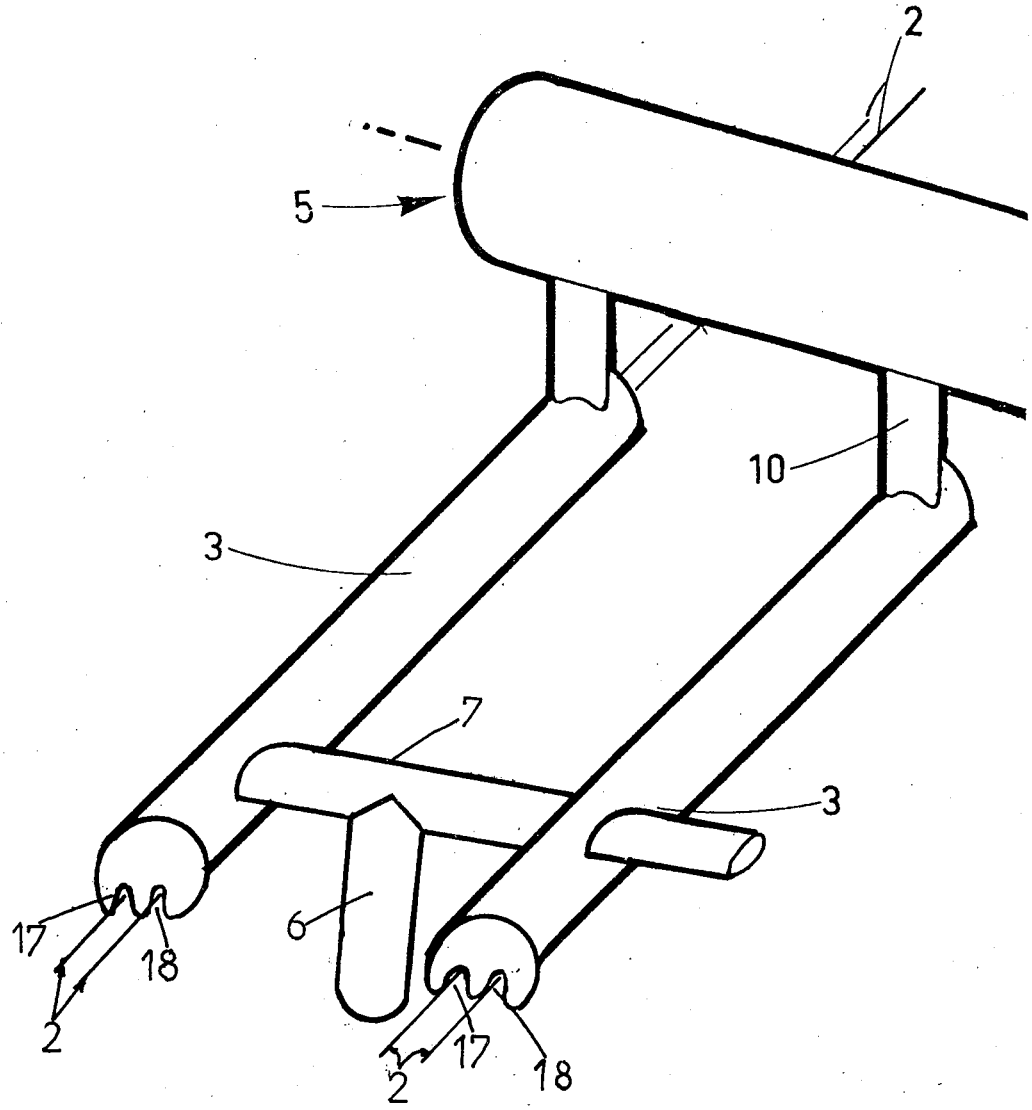

In order that the invention may be more clearly understood, the following description is given, merely by way of example, with reference to the accompanying drawings in which:

FIG. 1 is a perspective view showing a closed oven including a device according to the invention, in which two treatment tubes have been represented, FIG. 2 is a vertical section along the axis A—A of FIG. 1, FIG. 3 is a vertical section along the axis B—B of FIG. 1, FIG. 4 is a detailed view, in partial section, showing the connection of the collector to each chamber, FIG. 5 illustrates a variant of the device shown in FIGS. 1 to 4, in which variant the vertical pipelines possessing the heating elements are fewer in number than the heat treatment chambers; and FIG. 6 schematically illustrates in perspective, an open oven including a device according to the invention.

The invention will be described in relation to its use as a first oven in a false-twist texturising machine, for example of type FTF 55, 75 or 90, built by the Applicant's Assignees, in which the oven is located substantially horizontally in the upper part of the machine, the angle formed by the said oven with the horizontal being about 20°.

As is known, such a machine possesses a plurality of positions for the treatment of the yarns arranged in parallel side by side, each position possessing a yarn heating device.

FIGS. 1 to 5 illustrate an embodiment in which the yarn heating device is in a closed oven.

The device consists of a plurality of treatment tubes 1, made of stainless steel or a similar material, through which tubes passes (in either direction) the moving yarn 2. Each tube is within and surrounded by a leak-proof chamber 3 to be heated by a heating fluid in the form of vapour. The chambers 3 are each connected at one end to a heating liquid reservoir 4 possessing heating means intended to vaporise the heating liquid and at their other ends to a shared collector 5 for recovering the non-condensable gas vapours.

The reservoir 4 consists of vertical pipes 6 which terminate in a shared horizontal pipeline 7, connecting the chambers 3 to one another. Each vertical pipe 6 is located below the shared horizontal pipeline 7 and possesses heating means, for example and as shown an electrical resistance 8 surrounding the said pipelines (see FIG. 2). The shared horizontal pipeline 7 is connected to the chambers 3 by means of connecting tubes 16, having the same length and diameter as the pipes 6.

In the variant illustrated in FIG. 5, the connection of the shared pipeline 7 to the chambers 3 is also provided by means of connecting tubes 16 equal in number to the said chambers, but the vertical pipes 6 are fewer in number and are arranged at regular intervals along the shared horizontal pipeline 7, below the latter, and have a greater diameter than the diameter of the connecting tubes 16.

It is even conceivable only to use a single vertical pipe 6 terminating in the shared horizontal pipeline 7.

The shared collector 5 consists of a chamber which is closed at its two ends and is in the shape of an elongate cylinder. This collector is located above the chambers 3 and is connected to each of them by a vertical pipeline 10, the length of which is of the order of 4 centimeters, whilst its diameter is about a quarter of that of the collector 5.

Each vertical pipeline 10 possesses, in its upper part near the collector 5 and slightly below the latter, a separator element 11 possessing, as shown, two orifices (see FIG. 3 and 4), which are of small diameter compared to the diameter of the pipeline 10.

In one embodiment, the pipelines 10 have a diameter of 23 mm whilst each of the orifices has a diameter of 2.5 mm.

As shown, the orifices are associated with channels 12 and 13 extending in opposite directions, so that the channel 12 terminates in the interior of the collector 5, whilst the channel 13 terminates substantially at the junction of the vertical tube 10 with the chamber 3.

The reservoir comprising the combination of the vertical pipes 6 and the horizontal connecting pipeline 7 contains a heating liquid (which is not shown), which in the present case is advantageously a liquid marketed under the trademark MARLOWTHERM; this liquid only partially fills the interior of the horizontal pipeline 7, regardless of whether it is hot or cold.

The above described device functions as follows. The electrical resistances 8 heat the heating liquid and bring it to the boil and the vapour produced fills the whole of the chambers 3 and the various tubes and pipelines. Any excess vapour passes via the orifices and channels 12 into the collector 9, where it condenses, and returns through the channels 13 into the heating fluid reservoir 6–7.

FIG. 6 illustrates an embodiment according to the invention which makes it possible to set-up an open heat treatment oven. In this Figure, for simplicity, the same reference numerals are used to denote the same components.

This open oven consists, as before, of a plurality of leak-proof chambers 3 which again make an angle of about 20° with the horizontal, though this angle can of course be different. These chambers are each connected at one end to a heating liquid reservoir 4 which possesses heating means to vaporise the liquid at the other end, to a shared collector 5 for recovering the non-condensable gas vapours.

In this embodiment, each chamber 3 possesses two channels 17–18 which allow two yarns 2 to be guided and heated.

The fluid reservoir 4 consists of vertical pipes 6 arranged below the chambers 3, and the chambers are connected to one another by a shared horizontal pipeline 7 which terminates in each chamber 3, whilst the vertical pipes 6 terminate between adjacent chambers 3.

The shared collector 5 for the recovery of the non-condensable gases is identical to that described above and is again connected to the chambers 3 by means of vertical pipelines 10 which, in their upper parts close to the collector 5, possess a separator element having at least one orifice of small diameter relative to the diameter of the vertical pipeline.

Such a device functions in the same way as described above, the only difference being that the yarn in the channels 17,18 is heated by direct contact with the chambers 3.

In all the described embodiments it is advantageous, though this is only shown in FIG. 1, to provide, at least at one of the ends of the oven, a conduit which connects the heating fluid reservoir 7 and the collector 5 and consists of two vertical parts 19, 20 connected to one another by a part 21 parallel to the chambers 3. These parts 19,20,21 preferably have the same diameter as the pipelines 10. A separator element 11,12,13, like that illustrated in FIG. 4, is located, not in the part 20 close to the collector 9, but, on the contrary, in the vertical part 19 close to the shared horizontal pipeline 7. This makes it possible, when starting up the oven and whilst the latter is cold, to facilitate the return of the liquid into the reservoir 4–6 and eliminates the danger, resulting from the differences in pressure between the chamber 3 and the shared collector 5 whilst the temperature is rising, that the liquid will remain in the said collector 5.

Devices constructed in accordance with the invention are simple and efficient and make it possible to heat-treat, with precision, yarns travelling at high speed.

I claim:

1. A yarn heating device comprising in combination a plurality of elongate chambers to be heated internally by a vapourised heating fluid, a reservoir for heating fluid connected to one end of each said chambers, said reservoir comprising a horizontal pipeline which interconnects the chambers and at least one vertical pipe below and connected to said horizontal pipeline, heating means being provided to each said vertical pipe, a cylindrical collector for recovering vapours, a plurality of pipelines connecting the other ends of said chambers to said collector, said collector being above said chambers, and a separator element having two orifices of smaller diameter than the diameter of the pipeline in each said pipeline at the upper end thereof near the collector, each separator element including respective channels extending in opposite directions from said two orifices, one said channel terminating inside the collector and the other terminating substantially at a connection between the pipeline and the associated chamber.

2. A yarn heating device as claimed in claim 1, wherein said heating means comprise respective electrical resistances associated with each said vertical pipe.

3. A yarn heating device as claimed in claim 1, wherein said horizontal pipeline of the reservoir opens directly into each said chamber.

4. A yarn heating device as claimed in claim 1 including respective vertical connecting tubes whereby said chambers are connected to the horizontal pipeline of the reservoir.

5. A yarn heating device as claimed in claim 1 including a tube through which moving yarn can pass extending through each said chamber.

6. A yarn heating device as claimed in claim 1 including, at the periphery of each chamber, at least one guide channel through which a moving yarn can travel.

7. A yarn heating device as claimed in claim 1 including at at least one side of the plurality of chambers, a conduit which connects said heating fluid reservoir and said collector, said conduit consisting of two vertical parts connected by a part parallel to the chambers, and a separator element having at least one orifice of smaller diameter than the conduit being located in the vertical part which is closest to said horizontal pipeline.

8. A yarn heating device as claimed in claim 1 provided with an amount of heating fluid such that both when cold and hot it only partially fills the horizontal pipeline.

9. A false twist texturizing machine including a yarn heating device as claimed in claim 1.

* * * * *